US007225898B2

(12) United States Patent
Bourgeois

(10) Patent No.: US 7,225,898 B2
(45) Date of Patent: Jun. 5, 2007

(54) LIFT

(76) Inventor: Alain Bourgeois, 30 Pinewood Lawn Abbeyside, Dungarvan Co., Waterford (IE)

( * ) Notice: Subject to any disclaimer, the term of this patent is extended or adjusted under 35 U.S.C. 154(b) by 0 days.

(21) Appl. No.: 10/562,690

(22) PCT Filed: Jun. 30, 2004

(86) PCT No.: PCT/FR2004/001682

§ 371 (c)(1),
(2), (4) Date: Dec. 27, 2005

(87) PCT Pub. No.: WO2005/003012

PCT Pub. Date: Jan. 13, 2005

(65) Prior Publication Data

US 2006/0180401 A1 Aug. 17, 2006

(30) Foreign Application Priority Data

Jun. 30, 2003 (FR) ..... 03 07868

(51) Int. Cl.
*B66B 9/08* (2006.01)

(52) U.S. Cl. ..... 187/200; 187/269; 187/272; 182/69.6; 182/149; 254/9 C; 254/114; 254/122; 74/39; 414/589

(58) Field of Classification Search ..... 187/200, 187/211, 269, 272; 182/69.6, 149; 254/9 C, 254/122, 126, 114, 130; 74/39, 521; 414/546, 414/589

See application file for complete search history.

(56) References Cited

U.S. PATENT DOCUMENTS 5,542,806 A 8/1996 Kang

FOREIGN PATENT DOCUMENTS

DE 42 34 490 4/1993

*Primary Examiner*—Eileen D. Lillis
*Assistant Examiner*—Stefan Kruer
(74) *Attorney, Agent, or Firm*—Young & Thompson

(57) ABSTRACT

A lift between lower and upper levels of a house includes a cabin and an essentially horizontal platform which is essentially vertically movable by actuating elements arranged thereunder. The actuating elements include at least one pair of rotatably mounted arms pivotally arranged around an axis in the middle part thereof. The free ends of the first arm of one pair are pivotable around a fixed axis and respectively around an axis sliding along the platform. The free ends of the second arm are pivotable around a fixed axis connected to the platform and respectively around a sliding axis. An actuating unit interacts with at least one of the arms such that the pivot axis of the second arm for the platform, the middle pivot axis of the arms of the pair and the pivot axis of the first arm are never aligned.

11 Claims, 2 Drawing Sheets

LIFT

BACKGROUND OF THE INVENTION

The present invention pertains to a lift intended to transport persons between a lower level and an upper level, for particular installation in dwellings to facilitate access to floors for users with reduced mobility such as elderly, handicapped persons.

In this area lifts are known comprising a cabin or horizontal platform able to be translated vertically within a vertical shaft from a lower floor to an upper floor, or the reverse, using actuating means; this is the case for example in French patent FR 2 584 694 which describes a hydraulic lift with cabin. The hydraulic lift comprises a cabin which is linked, via support means and return pulleys, to a hydraulic cylinder which can be moved in the direction of travel of the cabin, the cabin being raised and lowered through the inflow and outflow of a working liquid. The inflow of working liquid to the hydraulic cylinder is made by means of a pump driven by a motor. Therefore the piston rod of the hydraulic cylinder anchored fixedly with its upper end, which may emerge under the effect of weightlessness to cause the cabin to rise, is linked at its end to a pulley guiding the support means anchored fixedly at one of their ends and anchored to the cabin at their other end.

Although the actuating means of this type of lift are of limited volume, the installation of this type of lift requires structural work within the dwelling which adds considerably to the installation costs of this type of lift.

So-called hydraulic lifts are also known whose cabin is linked to the piston of a hydraulic cylinder to lower and raise said cabin through the respective inflow and outflow of a working liquid in and out of the hydraulic cylinder; this is the case for example in German patent DE 3 136 739. The hydraulic cylinder is connected via a pump to a pressure accumulator in the form of a cylinder whose piston is loaded by a counterweight through the piston rod.

It will be noted that the length of the hydraulic cylinder corresponds to the maximum travel distance of the cabin, so that the elevation height of the cabin is particularly limited.

To overcome this drawback, hydrostatic driving devices have already been imagined allowing long travel distances. This is the case for example in European patent EP 0 374 500 describing a scissor lift system which can be used in garages in particular to raise vehicles, comprising two pairs of legs mounted scissor fashion, one of the free ends of one leg of a pair pivoting about a fixed pin secured to the floor, the other end pivoting about a pin sliding along one of the side edges of the lift frame, the other leg having one end pivoting about a fixed pin secured to the side of the lift frame and its other end pivoting about a pin sliding along the floor. The two legs of a pair are pivot mounted about a pin supporting a connecting rod pivotally connected to the ends of the two hydraulic rams acting as actuating member about an axis that is off-centred from its assembly axis, able to pivot 90° between a globally horizontal position and a position in which it is locked in rotation. The connecting rod is advantageously provided with rollers to allow rapid rising of the pivot pin linking together the two legs of a pair when the lift frame is in lower position. Also the existence of the connecting rod itself, through its pivoting and by gear reduction, enables rapid rising of the pivot pin linking together the two legs of a pair.

This type of lift has the disadvantage of requiring structural or demolition work at the bottom of the shaft to form a pit located under the lower level to house the hydrostatic driving device, which considerably adds to the installation costs of said lifts. Failing this, the lift platform cannot lie flush with the floor level when the lift is in lower position, the legs and actuating body being arranged underneath the platform.

SUMMARY OF THE INVENTION

One of the purposes of the invention is therefore to overcome this disadvantage by proposing a lift of simple, low cost design avoiding the need for a pit at the bottom of the lift shaft.

For this purpose and according to the invention, a lift is proposed between a lower level and an upper level, comprising a substantially horizontal cabin or platform able to be translated vertically within a vertical shaft from a lower level to an upper level, or the reverse, using actuating means positioned under the platform, remarkable in that said actuating means comprise firstly at least one pair of arms mounted scissor fashion i.e. pivoting about a pin in their median part, the free ends of a first arm of a pair pivoting about a fixed pin secured to the shaft and respectively with the platform about a pin sliding along one of the side edges of the platform, and the free ends of the second arm pivoting about a fixed pin secured to the side edge of said platform and respectively with the shaft about a sliding pin, so that the pivot pin for the second arm with the platform, the median pivot pin for the arms of one pair and the pivot pin for the first arm with the shaft are never aligned, and also comprises an actuating member cooperating with at least one of the arms, the actuation of said member causing rotation of the first arm from a first position in which said second arm extends above the sliding pin to a second lower position in which said first arm extends underneath said sliding pin, thereby ensuring translation of the platform from a first position in which it extends at the upper level of the dwelling to a second position in which it extends at the lower level underneath said sliding pin, and the reverse.

The actuating member preferably consists of a ram whose body is joined to the shaft and whose rod articulates with a connecting rod which pivots with one of the arms of the pair, so that the pivot pins of the connecting rod with the piston rod, of the connecting rod with the first arm and of said first arm with the shaft are never aligned.

Also and in particularly advantageous manner, the shaft consists of a frame comprising two rear uprights, two lower sidebars and rear crossbars, the free ends of the first arm of a pair pivoting about a fixed pin secured to the rear end of the lower sidebars and respectively with the plateau about a pin sliding along one of the side edges of the platform, and the free ends of the second arm pivoting about a fixed pin secured to the side edge of the platform and respectively with said lower sidebar about a pin sliding along a longitudinal lumen made in said sidebar.

It will be understood that, contrary to prior art devices in which the rod of the hydrostatic driving device is secured to the lower wall of the cabin, bearing upon the ground underneath the lower level, the ram used to drive the platform from the lower level to the upper level and the reverse extends above said lower level so that the installation of this type of lift in a dwelling does not require demolition work to form a pit.

In particularly advantageous manner, one of the arms of each pair of arms consists of two segments, a first segment and a second segment extending linear fashion and in parallel along two separate vertical planes, said segments being connected by a fixed pin secured to the respective free ends of the first and second segments and crossing through the first arm of the pair.

BRIEF DESCRIPTION OF THE DRAWINGS

Other advantages and characteristics will become better apparent from the following description of a lift of the invention with reference to the appended drawings in which.

DESCRIPTION OF THE PREFERRED EMBODIMENTS

Figure 1:
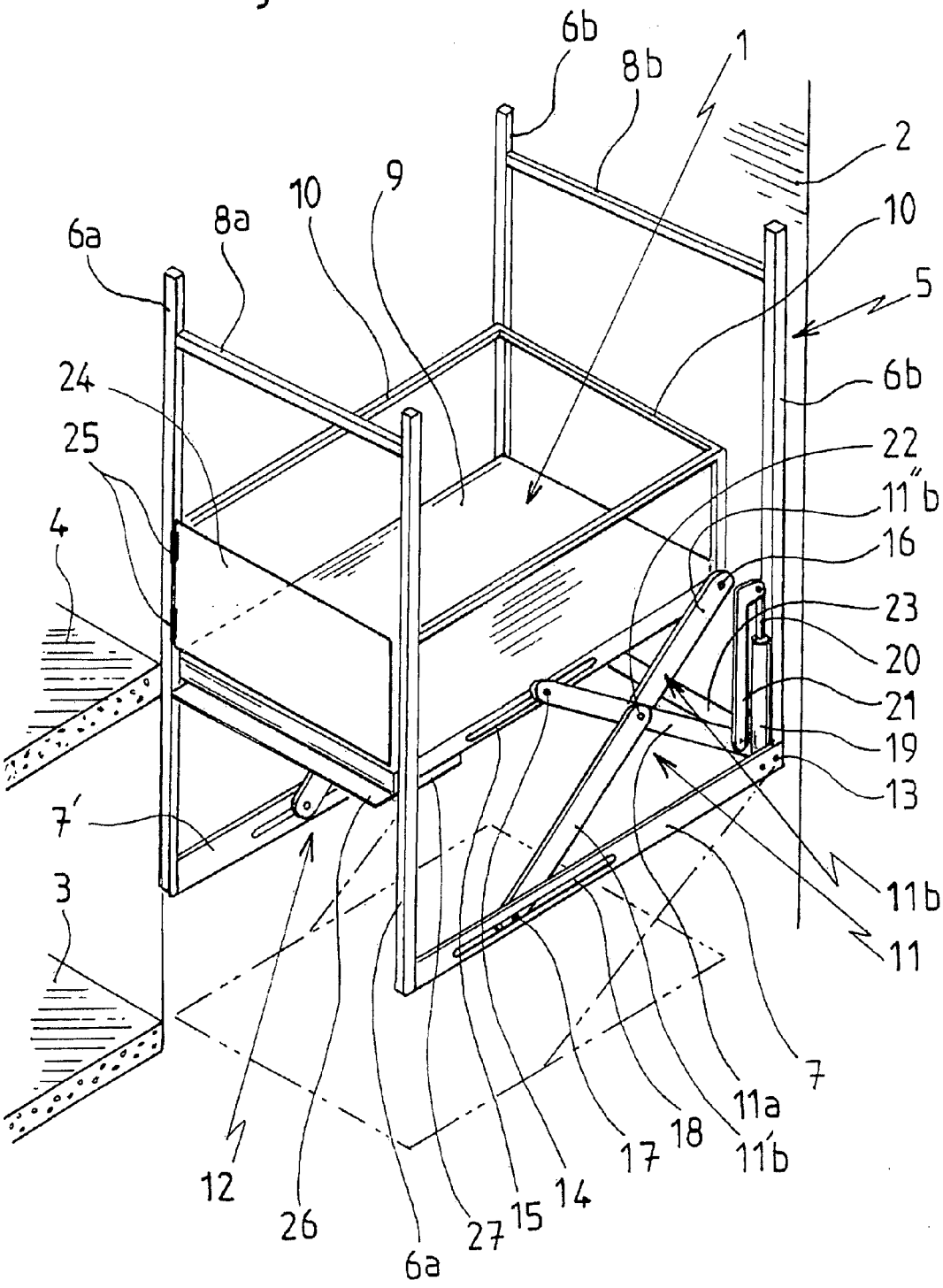
FIG. 1 is a perspective view of the lift of the invention.
Figure 2:
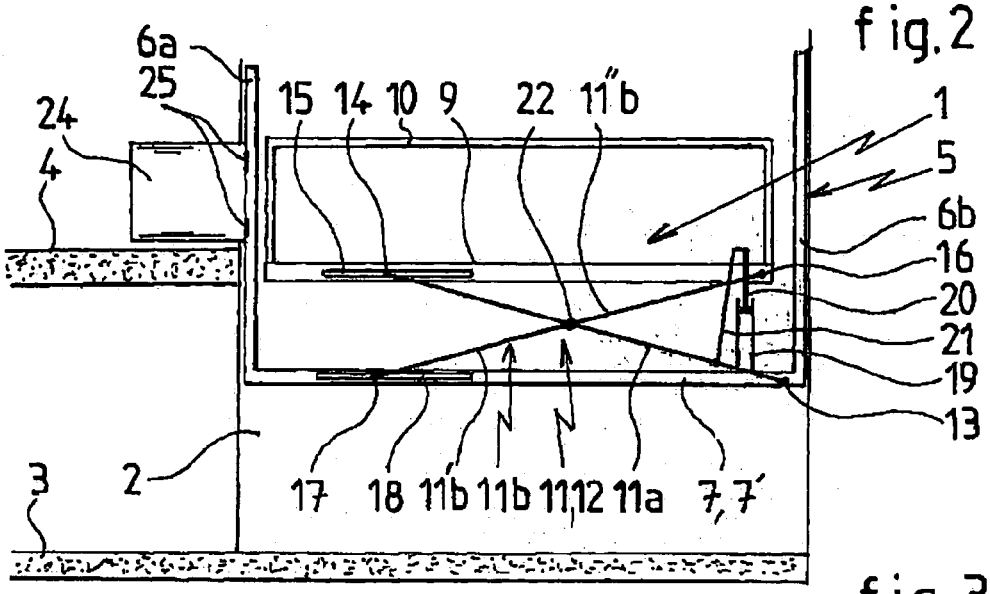
FIG. 2 is a vertical section view of the lift of the invention, the platform being at the upper level.
Figure 3:
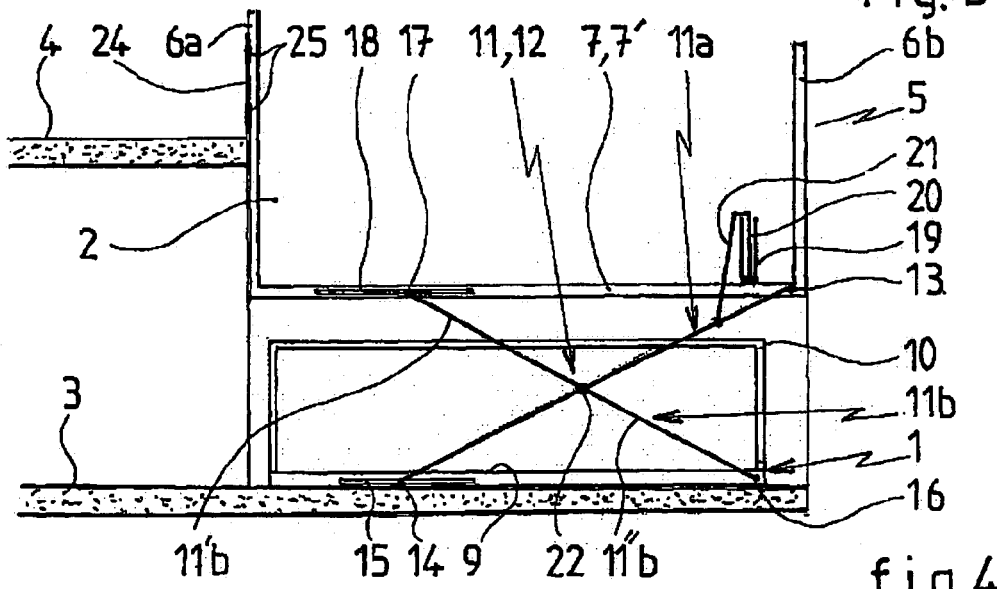
FIG. 3 is a vertical section view of the lift of the invention, the platform being at the lower level.

With reference to FIGS. 1 to 3, the lift of the invention between a lower level and an upper level of a dwelling comprises a substantially horizontal platform 1 able to be translated vertically within a vertical shaft 2 from the lower level 3 to the upper level 4, and the reverse, using actuating means positioned underneath said platform 1. The shaft 2 consists of a frame 5 comprising two front uprights 6*a* and two rear uprights 6*b*, two lower sidebars 7, 7' and front 8*a* and rear crossbars 8*b*. The lower sidebars 7, 7' of the shaft 2 extend above the lower level 3 of the dwelling in order to increase the vertical clearance of platform 1 as will be detailed below. The horizontal platform 1 consists of a globally rectangular plateau 9 which, on its side edges and on its rear transverse edge, comprises railings 10 conventionally formed of uprights and crossbars forming guard rails.

The lift also comprises two pairs of arms 11 and 12 mounted scissor fashion i.e. a pair of arms pivoting about a pin in their median part, respectively pivoting with the side edges of platform 1. The free ends of the first arm 11*a* of one pair 11 pivot about a fixed pin 13 secured to the rear end of a lower sidebar 7 of frame 5 of shaft 2 and respectively pivot with platform 1 about a pin 14 sliding along one of the side edges of said platform 1 through a longitudinal lumen 15. The free ends of the second arm 11*b* pivot about a fixed pin 16 secured to the side edge of platform 1 and respectively, in the median part of the lower sidebar 7 of frame 5 of shaft 2, about a pin 17 sliding through a longitudinal lumen 18 made in the median part of said lower sidebar 7. It is to be noted that since the pairs of arms 11 and 12 pivot with the side edges of the platform 1, the space located beneath the platform is entirely free enabling said platform 1 to extend at lower level 3 without any demolition work being necessary.

The lift also comprises a ram 19 supplied by a hydraulic motor, not shown in the figures, so as to actuate said platform 1. This ram 19 extends vertically along the rear upright 6*a* of frame 5 of shaft 2 above the lower sidebar 7, and the rod 20 of said ram 19 articulates with a connecting rod 21 pivoting with the first arm 11*a* of the pair between the pivoting of said first arm 11*a*, about fixed pin 13 secured to the rear end of lower sidebar 7 of frame 5 of shaft 2, and the pivot pin of the first and second scissor-mounted arms 11*a* and 11*b* so that the pivot pins of connecting rod 21 with rod 20 of ram 19, of connecting rod 21 with the first arm and of said first arm 11*a* with the shaft 2 are never aligned. Therefore the vertical translation of rod 20 of ram 19 causes rotation of the first arm from a first position in which said second arm extends above the lower sidebars 7, 7' of frame 5 of shaft 2 to a second lower position in which said first arm 11*a* extends underneath said lower sidebars 7, 7' thereby causing translation of platform 1 from a first position in which it extends at the upper floor 4 of the dwelling to a second position in which it extends at the lower floor 3 underneath the lower sidebars 7, 7' of frame 5 of shaft 2.

Evidently, the lower position of platform 1 may merge with the plane of the lower sidebars 7, 7' of frame 5 of shaft 2 without departing from the scope of the invention. Nonetheless it will be understood that for the same vertical clearance of platform 1, provision must be made for a ram 19 whose clearance of rod 20 is greater.

Figure 4:
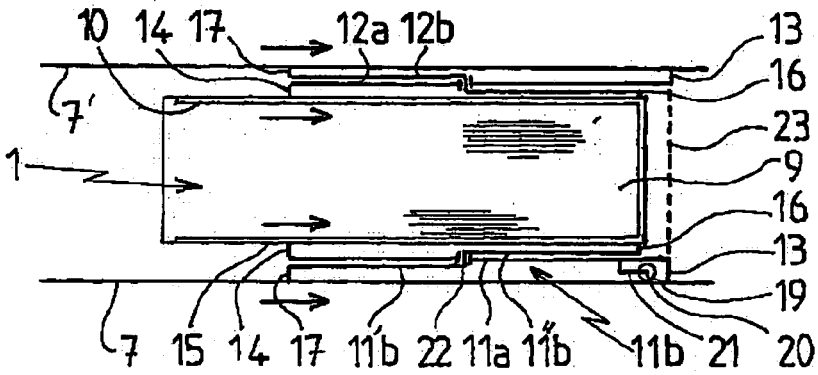
FIG. 4 is a schematic overhead illustration of the lift of the invention.

With reference to FIG. 4, it will be seen that one of the arms of each pair of arms 11, 12 mounted scissor fashion, second arm 11*b* for example, consists of two segments, a first segment 11'*b* extending from lower sidebar 7 as far as the first arm 11*b* of pair 11, and a second segment 11"*b* extending from the first arm 11*a* of pair 11 as far as platform 1. These segments 11'*b* and 11"*b* extend linear fashion and in parallel along two separate vertical planes and are connected by a fixed pin 22 secured to the respective free ends of the first and second segments 11'*b*, 11"*b* and crossing the first arm 11*a* of pair 11. Therefore the first and second segments 11"*b* and 11"*b* pivot about a pin 2 passing through the first arm 11*a*.

According to a particularly advantageous variant of embodiment shown by the dotted line in FIG. 4, the free ends of arms 11*a* of the first pair 11 of arms are joined to the respective free ends of arms 12*a* of the second pair 12 of arms by a connecting bar 23, so that the rotation of the first arm 11*a* of the first pair 11 caused by actuation of ram 19 simultaneously drives in rotation the first arm 12*a* of the second pair 12. In this respect it will be noted that arms 11*a* and 12*a* of pairs 11 and 12 project beyond the rear of platform 1 to allow the passing of the connecting bar 23 behind the platform when it is moved from the lower level 3 to the upper level 4 and the reverse, said connecting bar 23 extending along the plane of platform 1 when the latter is located at the level of lower sidebars 7, 7' of frame 5.

Accessorily with reference to FIG. 1, the lift comprises a gate 24 at upper level 4 pivoting about hinges 25 secured to the front uprights of frame 5 of shaft 2 so that said gate 24 is closed preventing access to shaft 2 when platform 1 is located at the lower level 3 to prevent any falls from the upper level 4.

It will be seen that the vertical movement of the platform 1 inside shaft 2 is not linear but slightly curved so that, when said platform 1 is located at lower level 3 or upper level 4, said platform 1 is separated from the floor of lower level 3 or upper level 4 by a space. To prevent injury through a user's foot getting trapped in this space, the front edge of platform 1 advantageously comprises a retractable guard 26, that is pre-stressed by elastic means and able to slide along rails 27 positioned underneath said platform 1 to fill said space.

Evidently ram 19 may be substituted by any other actuating member known to persons skilled in the art without departing from the scope of the invention, the pivot pin of the actuating member with arm 11*a* and the pivot pin of said arm 11*a* with shaft 2 never to be vertically aligned.

Also it is evident that the means for actuating said horizontal platform may only comprise one pair of scissor-mounted arms, the free ends of a first arm of a pair pivoting about a fixed pin, secured to the shaft, and respectively with the plateau about a sliding pin, and the free ends of the second arm pivoting about a fixed pin secured to said platform and respectively with the shaft frame about a sliding pin.

Finally it is evident that the horizontal platform of the lift may be substituted by a cabin, and that the examples just given are only particular illustrations that are in no way restrictive regarding the sphere of application of the invention.

The invention claimed is:

1. Lift for a dwelling having a lower level (3) and an upper level (4), the lift comprising:

a cabin or horizontal platform (1) able to be moved substantially vertically within a shaft (2) from the lower level to the upper level, and the reverse, using actuating means positioned underneath the platform (1), wherein said actuating means includes at least one pair of scissor-mounted arms (11) pivoting about a middle pin (22) in a middle part of said at least one pair (11), one end of a first arm (11*a*) of said at least one pair (11) pivoting about a first fixed pin (13) secured to said shaft (2) and a second end of the first arm pivoting with the platform about a second pin (14) sliding along a first side edge of said platform (1), and one end of a second arm (11*b*) of said at least one pair pivoting about a third fixed pin (16) secured to the first side edge of said platform (1) and a second end of the second arm pivoting with the shaft (2) about a fourth sliding pin (17), so that the first, second and third pins are never aligned, and an actuating member cooperating with at least one (11*a*) of said first and second arms (11*a*, 11*b*), the actuation of said actuating member causing rotation of the first arm from a first position in which said second arm extends above said fourth sliding pin (17) to a second lower position in which said first arm, (11*a*) extends underneath said fourth sliding pin (17), thereby moving said platform (1) from a first position at the upper level (4) to a second position at the lower level (3) underneath said fourth sliding pin (17), and the reverse.

2. Lift as in claim 1, wherein said second arm includes a first segment (11'*b*) and a second segment (11"*b*) extending linearly and in parallel along two separate vertical planes; said first and second segments (11'*b*) and (11"*b*) being joined by said middle pin (22) that is secured to respective ends of the first and second segments (11'*b*, 11"*b*) and passing through the first arm (11*a*).

3. Lift as in claim 1, wherein said shaft includes a frame (5) comprising front (6*a*) and rear (6*b*) uprights, lower sidebars (7, 7') extending horizontally between the lower level (3) and upper level (4), and front (8*a*) and rear (8*b*) crossbars, and wherein the platform (1) extends underneath the lower sidebars (7, 7') of said frame (5) when said platform (1) is at the lower level (3), and above said sidebars (7, 7') when said platform (1) is at the upper level (4).

4. Lift as in claim 1, comprising two pairs of said scissor-mounted arms (11, 12) at opposite side edges of the platform (1).

5. Lift as in claim 1, wherein the actuating member includes a ram (19) whose body is joined to the shaft (2) and whose rod (20) articulates with a connecting rod (21) pivoting with said first arm so that (a) a pivot pin of the connecting rod (21) with the rod (20) of the ram (19), (b) a pivot pin of the connecting rod (21) with the first arm (11*a*), and (c) said first pin (13) are never aligned.

6. Lift as in claim 2, wherein said shaft includes a frame (5) comprising front (6*a*) and rear (6*b*) uprights, lower sidebars (7, 7') extending horizontally between the lower level (3) and upper level (4), and front (8*a*) and rear (8*b*) crossbars, and wherein the platform (1) extends underneath the lower sidebars (7, 7') of said frame (5) when said platform (1) is at the lower level (3), and above said sidebars (7, 7') when said platform (1) is at the upper level (4).

7. Lift as in claim 3, further comprising a gate (24) pivoting about hinges (25) secured to the front uprights (6*a*) of the frame (5) at the upper level (4).

8. Lift as in claim 3, wherein the first fixed pin (13) is secured to an end of one of the lower sidebars (7) of the frame (5) and the second pin (14) sliding in a slot (15) in the first side edge of said platform (1), and wherein the third fixed pin (16) is secured to the first side edge of said platform (1) and the fourth pin (17) sliding in a slot (18) in said one lower sidebar (7).

9. Lift as in claim 4, wherein said one end of said first arm of a first pair (11) of said two pairs of scissor-mounted arms is joined to said one end of said first arm of a second pair (12) of said two pairs of scissor-mounted arms via a connecting bar (23).

10. Lift as in claim 5, wherein the ram (19) extends vertically along the shaft (2).

11. Lift as in claim 10, wherein the rod (20) of the ram (19) extends above the body of the ram.

* * * * *